US005494147A

United States Patent [19]

Takahashi et al.

[11] Patent Number: 5,494,147

[45] Date of Patent: Feb. 27, 1996

[54] COIN DISCRIMINATING APPARATUS

[75] Inventors: Masataka Takahashi, Matsudo; Mitsuhiro Nagase, Tokyo, both of Japan

[73] Assignee: Laurel Bank Machines Co., Ltd., Tokyo, Japan

[21] Appl. No.: 291,557

[22] Filed: Aug. 16, 1994

[30] Foreign Application Priority Data

Aug. 19, 1993 [JP] Japan ..... 5-205435
Aug. 3, 1994 [JP] Japan ..... 6-182117

[51] Int. Cl.[6] ..... G07D 5/00
[52] U.S. Cl. ..... 194/328
[58] Field of Search ..... 194/317, 318, 194/319, 328, 207, 206

[56] References Cited

U.S. PATENT DOCUMENTS

| | | | |
|---|---|---|---|
| 4,646,351 | 2/1987 | Asbo et al. | 382/3 |
| 4,742,903 | 5/1988 | Trummer | 194/317 |
| 4,819,780 | 4/1989 | Trummer et al. | 194/317 |

FOREIGN PATENT DOCUMENTS

| | | |
|---|---|---|
| 218407 | 4/1987 | European Pat. Off. . |
| 2380601 | 9/1978 | France . |
| 5-46840 | 2/1993 | Japan . |
| 2248333 | 4/1992 | United Kingdom . |
| 87 00661 | 1/1987 | WIPO . |

OTHER PUBLICATIONS

William H. Beyer, PH.D., "Analytic Geometry, Formulas for Use in Analytic Geometry" CRC Standard Mathematical Tables, 1978, p. 292.

Jacobson, et al; "Invariant analogical image representation and pattern recognition", Pattern Recognition Letters 2 (1984) pp. 289-299, Sep. 1984.

Fukumi, et al: "Invariant Neural Pattern Recognition System with Application to Coin Recognition", IEEE Transactions on Neural Networks 3 (1992) March, No. 2, New York, U.S.

*Primary Examiner*—F. J. Bartuska
*Attorney, Agent, or Firm*—Cushman, Darby & Cushman

[57] ABSTRACT

A coin discriminating apparatus including a light projector for projecting light onto a coin, a light receiver for receiving light reflected by the coin and producing pattern data of the coin, pattern data memory for storing the pattern data as mapped into an x-y coordinate system, a center coordinate calculator for determining a center coordinate of the pattern data mapped in the x-y coordinate system in the pattern data memory, a pattern data converter for, based upon the center coordinate of the pattern data in the x-y coordinate system, the pattern data stored in the pattern data memory into an r-θ coordinate system and producing converted pattern data, a reference pattern data memory for storing reference pattern data mapped in the r-θ coordinate system and a coin discriminator for correcting the converted pattern data along a θ-axis and comparing the corrected converted pattern data with the reference pattern data to discriminate the coin. According to the thus constituted coin discriminating apparatus, it is possible to discriminate coins with high accuracy and at high speed.

8 Claims, 7 Drawing Sheets

COIN DISCRIMINATING APPARATUS

BACKGROUND OF THE INVENTION

The present invention relates to a coin discriminating apparatus and, in particular, to a coin discriminating apparatus for discriminating coins by optically detecting coin surface patterns.

DESCRIPTION OF THE PRIOR ART

Japanese Patent Application Laid-Open No. 5-46840 proposes a coin discriminating apparatus which optically detects the surface patterns of coins and compares them with reference patterns, thereby discriminating the denominations of coins, the genuineness of coins, whether or not coins are foreign coins and the like.

In this coin discriminating apparatus, coin discrimination is made as follows. Light is projected onto a coin at a shallow angle and light reflected by the coin is detected to obtain optical data that are converted to binary image data. The thus obtained binary image data are divided into sets of binary image area data corresponding to a plurality of annular areas of the coin surface. Then, from among sets of reference binary data which have been determined for respective predetermined annular areas and for each coin denomination, the sets of reference binary data of a coin having the same outer diameter as that of the coin being discriminated are selected and the sets of binary image area data are compared with the sets of reference binary image area data of the corresponding annular areas as the sets of binary image area data are rotated to the angles where the sets of binary image area data are most similar to the corresponding sets of reference binary image area data. If the thus obtained angles for all sets of binary image area data coincide, it is discriminated that the denomination of the coin coincides with that of the selected reference binary data and, otherwise, it is discriminated that the coin is counterfeit or foreign and unacceptable.

According to this coin discriminating apparatus, the surface of a coin is divided into a plurality of annular areas and when the surface pattern of each annular area coincides with the reference pattern of the corresponding annular area of a coin having the same outer diameter, it is discriminated that the denomination of the coin coincides with that of the selected reference pattern, whereas, otherwise, it is discriminated that the coin is unacceptable. In order to achieve high discrimination accuracy, therefore, it is necessary to divide the coin surface into numerous narrow annular areas. On the other hand, if the surface of a coin is divided into many narrow annular areas, it is necessary to obtain a separate set of reference binary image area data corresponding to each of the annular areas and to rotate the respective sets of binary image area data to obtain angles where the respective sets of binary image area data are most similar to the corresponding sets of reference binary image area data. Accordingly, although the discrimination accuracy can be improved, much time is required for the calculations needed for discriminating coins.

SUMMARY OF THE INVENTION

It is therefore an object of the present invention to provide a coin discriminating apparatus capable of discriminating coins with high accuracy and at high speed.

The above and other objects of the present invention can be accomplished by a coin discriminating apparatus comprising irradiating means for projecting light onto a coin, light receiving means for receiving light reflected by the coin and producing pattern data of the coin, pattern data storing means for storing the pattern data as mapped into an x-y coordinate system, center coordinate determining means for determining a center coordinate of the pattern data mapped in the x-y coordinate system in the pattern data storing means, pattern data converting means for, based upon the center coordinate of the pattern data in the x-y coordinate system determined by the center coordinate determining means, the pattern data stored in the pattern data storing means into an r-θ coordinate system and producing converted pattern data, reference pattern data storing means for storing reference pattern data mapped in the r-θ coordinate system and coin discriminating means for correcting the converted pattern data along a θ-axis and comparing the corrected converted pattern data with the reference pattern data to discriminate the coin.

In a preferred aspect of the present invention, denomination determining means is further provided for tentatively determining a coin denomination based upon the pattern data stored in the pattern data storing means and the coin discriminating means is constituted so as to discriminate the coin by comparing reference pattern data of the denomination tentatively determined by the denomination determining means and the corrected converted pattern data.

In a further preferred aspect of the present invention, each of the reference pattern data consists of those of both surfaces of coin of one denomination.

In a still further preferred aspect of the present invention, the irradiating means comprises light emitting means for emitting light and light directing means for uniformly directing light emitted from the light emitting means onto the surface of the coin at a shallow angle.

The above and other objects and features of the present invention will become apparent from the following description made with reference to the accompanying drawings.

DESCRIPTION OF THE PREFERRED EMBODIMENTS

Figure 1:
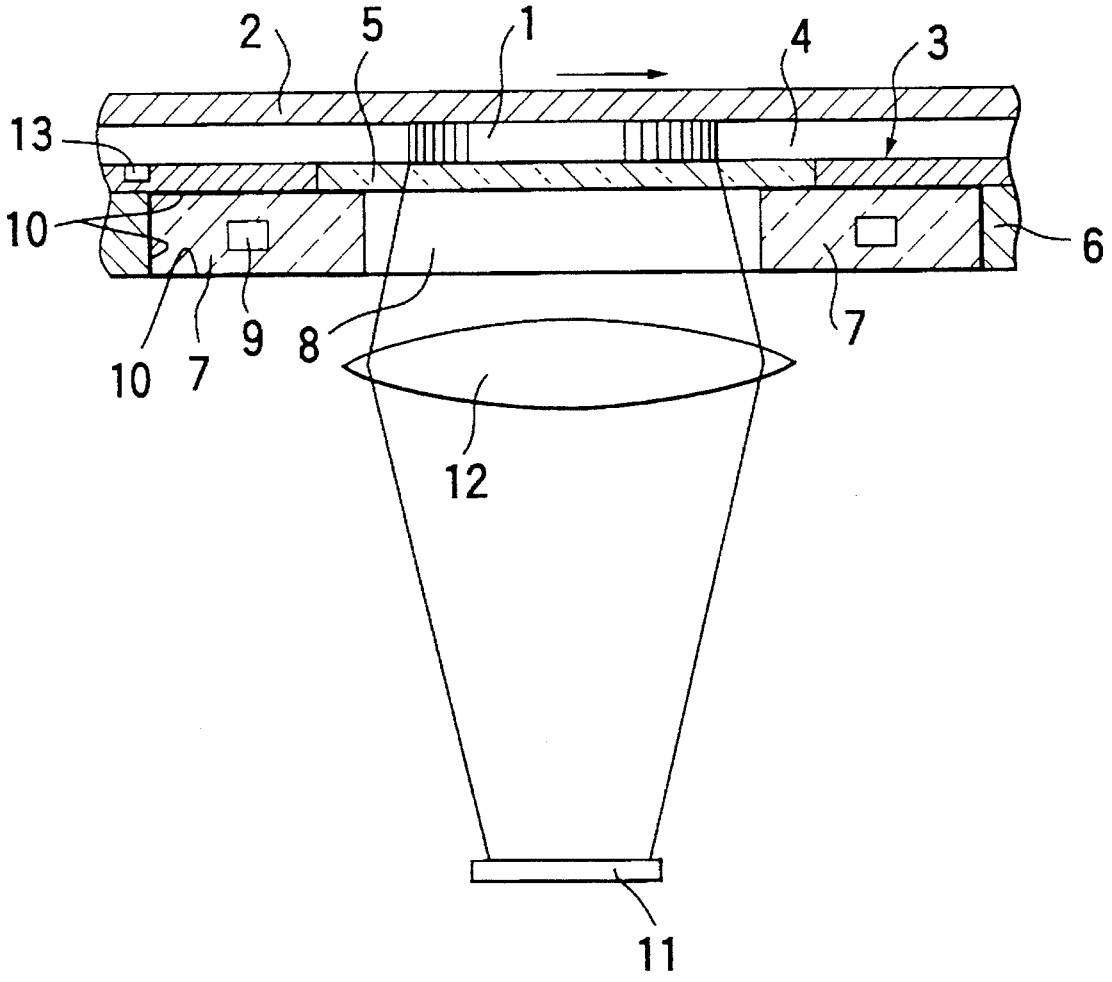
FIG. 1 is a schematic cross sectional view of a coin discriminating portion of a coin discriminating apparatus which is an embodiment of the present invention.

As shown in FIG. 1, a coin 1 is pressed onto the surface of a coin passage 3 by an endless belt 2 and fed in the coin passage 3 along a pair of guide rails 4 (only one is shown in FIG. 1) in the direction indicated by an arrow. A part of the coin passage 3 is formed with a transparent member 5 made of glass, acrylic resin or the like through which light can transmit and a support plate 6 is provided for supporting the coin passage 3 in such a manner that it contacts the lower surface of the coin passage 3. A portion of the support plate 6 below the transparent member 5 is formed with a transparent plate 7 made of glass, acrylic resin or the like through which light can transmit. A portion of the transparent plate 7 below the transparent member 5 is formed with a hole 8 greater than the largest coin to be discriminated and equal to the distance between the pair of guide rails 4. The transparent member 5 is arranged so as to cover the hole 8.

Figure 2:
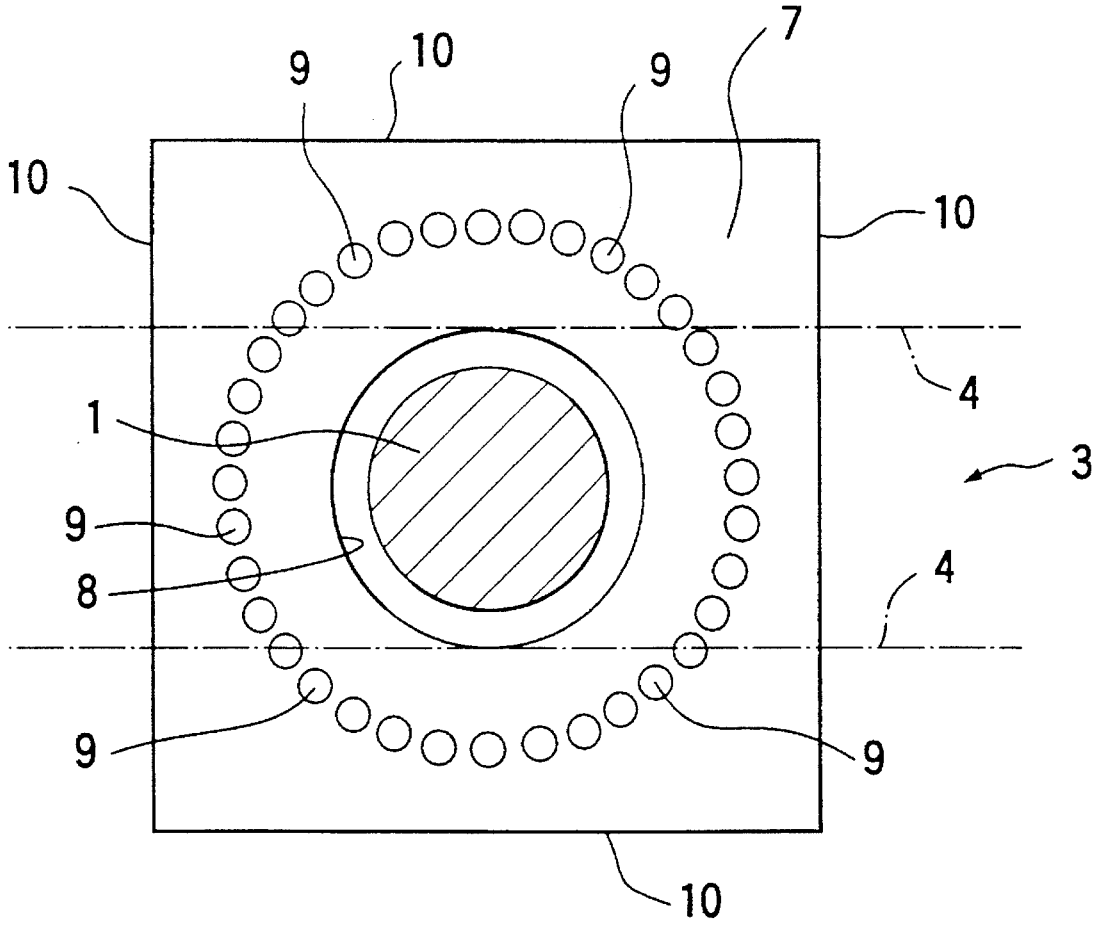
FIG. 2 is a schematic lateral cross sectional view showing a transparent plate.

FIG. 2 is a schematic lateral cross sectional view showing a transparent plate 7.

As shown in FIG. 2, a plurality of light emitting elements 9 are annularly arranged in the transparent plate 7 and reflection members 10 made of aluminum foil or the like are provided on the inner surfaces of side portions and upper and lower inner surfaces of the transparent plate 7. The hole 8 of the transparent plate 7 is formed by grinding.

Accordingly, light emitted from the plurality of light emitting elements 9 is repeatedly reflected by the reflection members 10 provided on the inner surfaces of side portions and upper and lower inner surfaces of the transparent plate 7 so as to become uniform before entering the hole 8. Since the direction of incident light is uniform and the positional relationship between the hole 8 and the coin 1 is determined as shown in FIGS. 1 and 2, light is projected onto the back surface of the coin 1 at a shallow angle with respect to the back surface of the coin 1.

Light projected onto and reflected by the back surface of the coin 1 enters an area sensor 11 FIG. 1). A convex lens 12 is provided for ensuring that all light reflected by the back surface of the coin 1 enters the area sensor 11. A coin sensor 13 is provided at a portion of the coin passage 3 upstream of the transparent plate 7 for outputting a coin detection signal to the area sensor 11 when it detects the coin 1 so that the area sensor 11 can produce pattern data of the coin 1 based upon only light reflected by the back surface of the coin 1 located at a predetermined position above the hole 8.

Figure 3:
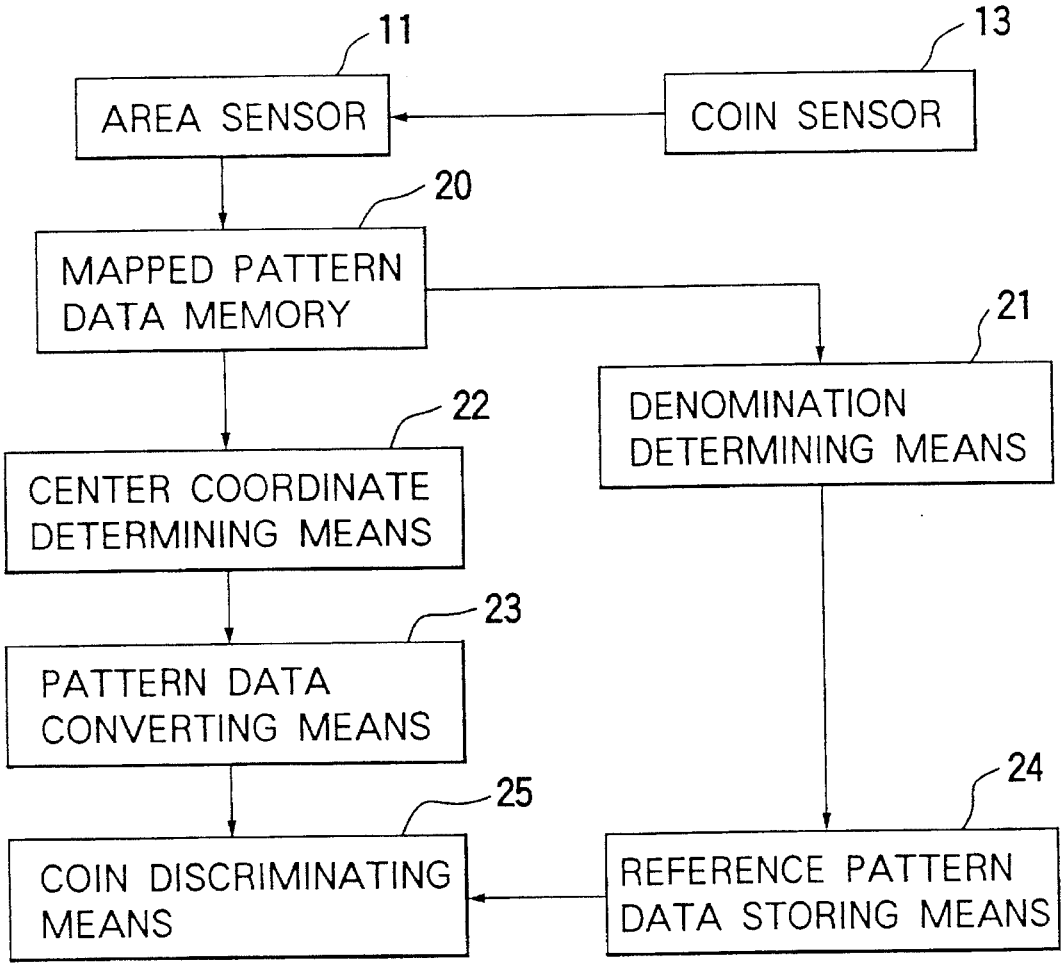
FIG. 3 is a block diagram of detection and discrimination systems of a coin discriminating apparatus which is an embodiment of the present invention.

FIG. 3 is a block diagram of the detection and discrimination systems of a coin discriminating apparatus which is an embodiment of the present invention.

The detection and discrimination systems of a coin discriminating apparatus which is an embodiment of the present invention include the area sensor 11 for detecting the surface pattern of the coin 1 at a predetermined timing based on the coin detection signal from the coin sensor 13 and producing pattern data, a mapped pattern data memory 20 for storing the pattern data of the coin 1 produced by the area sensor 11 as mapped into a rectangular coordinate system, namely, an x-y coordinate system, denomination determining means 21 for tentatively determining the denomination of the coin 1 based on the pattern data mapped and stored in the mapped pattern data memory 20 and outputting denomination signals, center coordinate determining means 22 for determining the center coordinate of the pattern data mapped and stored in the mapped pattern data memory 20, pattern data converting means 23 for transforming the pattern data into a polar coordinate system, namely, an r-θ coordinate system, reference pattern data storing means 24 for storing reference pattern data for each denomination of coin 1 and coin discriminating means 25 for comparing converted pattern data transformed into the r-θ coordinate system by the pattern data converting means 23 with the reference pattern data stored in the reference pattern data storing means 24 and discriminating the denomination of the coin 1, the genuineness of the coin 1 and whether or not the coin 1 is a foreign coin.

The denomination determining means 21 is constituted so as to calculate the diameter of the coin 1 based upon the pattern data mapped and stored in the mapped pattern data memory 20 and tentatively determine the denomination of the coin 1. The reference pattern data storing means 24 stores the pattern data of both surfaces of coin 1 of each denomination mapped in the r-θ coordinate system and is constituted so that in accordance with the denomination signal output from the denomination determining means 21, it can output reference pattern data of the coin 1 of the denomination corresponding thereto to the coin discriminating means 25.

Figure 4:
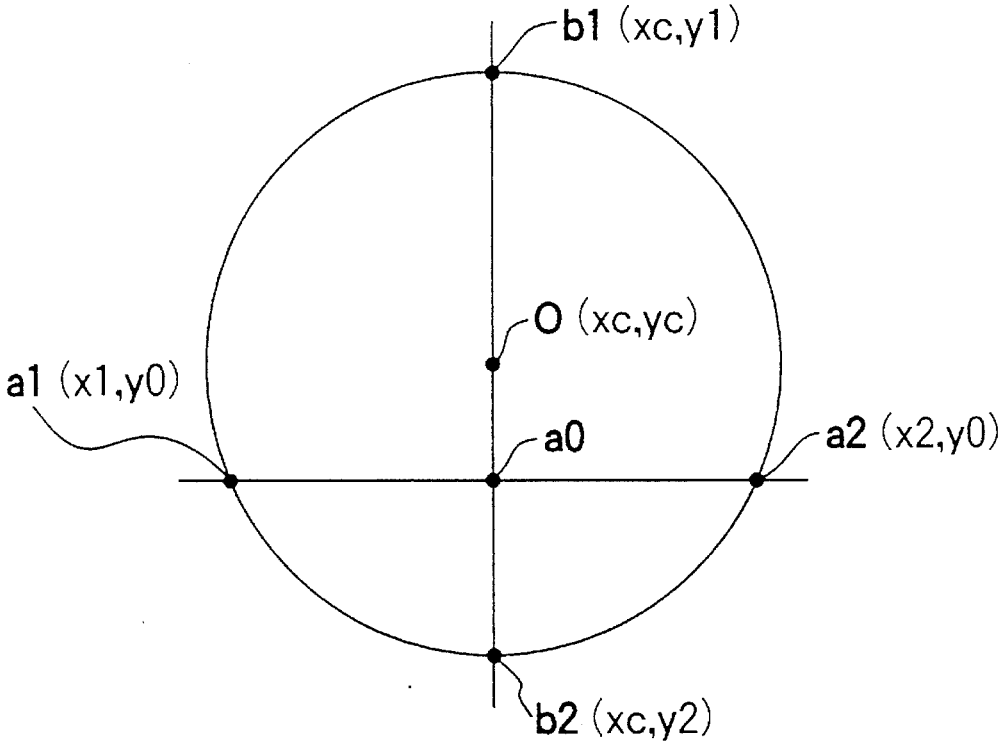
FIG. 4 is a schematic view showing a method for calculating the center coordinate of pattern data effected by center coordinate calculating means.

FIG. 4 is a schematic view showing a method for determining the center coordinate of pattern data effected by center coordinate determining means 22.

As shown in FIG. 4, the pattern data of the coin 1 produced by the area sensor 11 are mapped in the x-y coordinate system and stored in the mapped pattern data memory 20. The center coordinate determining means 22 determines x-coordinates x1 and x2 of boundary data a1 and a2 whose y-coordinate is y0 of the pattern data mapped and stored the mapped pattern data memory 20 and determines an x-coordinate $xc=(x1+x2)/2$ of a center data a0 between the boundary data a1 and a2. Then, the center coordinate determining means 22 draws an imaginary straight line from the data a0 perpendicular to a straight line extending through the boundary data a1 and a2 to determine y-coordinates y1 and y2 of boundary data b1 and b2 which correspond to the points of intersection of the imaginary straight line and the boundary of the pattern data and determines a y-coordinate $yc=(y1+y2)/2$ of center data 0 between the boundary data b1 and b2. The thus determined coordinates (xc, yc) of the data 0 corresponds to the center coordinate of the pattern data of the coin 1 mapped in the x-y coordinate system and the data 0 corresponds to the data center of the pattern data of the coin 1 mapped in the x-y coordinate system.

Figure 5:
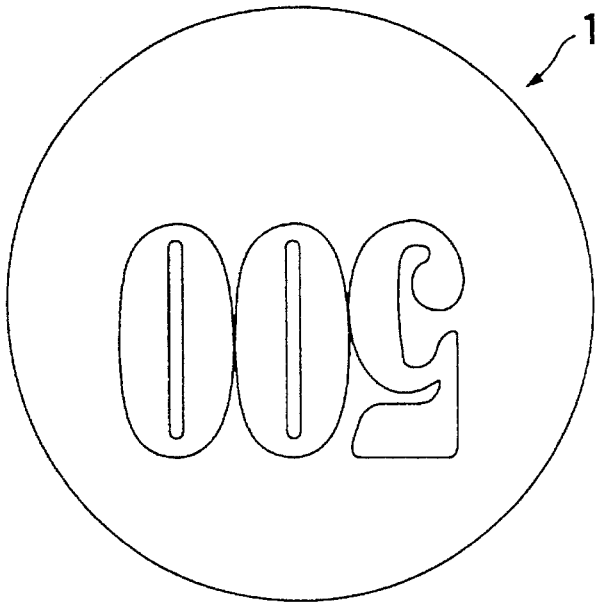
FIG. 5 is a view showing one example of pattern data of a coin produced by an area sensor and mapped and stored in a mapped pattern data memory.
Figure 6:
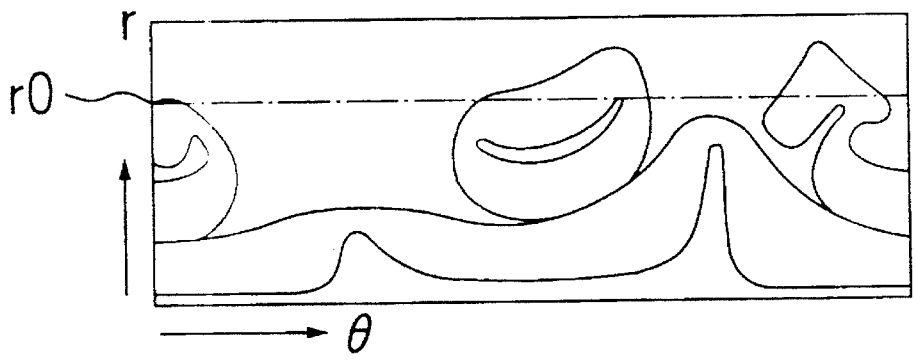
FIG. 6 is a view showing converted pattern data produced by transforming the pattern data shown in FIG. 5 into a polar coordinate system by pattern data converting means and stored in the pattern data converting means.

FIG. 5 shows one example of pattern data of a coin 1 produced by the area sensor 11 and mapped and stored in the mapped pattern data memory 20 and FIG. 6 shows converted pattern data produced in the pattern data converting means by transforming the pattern data shown in FIG. 5 into an r-θ coordinate system based upon the center coordinate (xc, yc) of the pattern data of the coin 1 determined by the center coordinate determining means 22. In FIG. 6, the ordinate represents the distance r from the data center O in the x-y coordinate system and the abscissa represents an angle θ about the data center O.

The converted pattern data transformed into the r-θ coordinate system by the pattern data converting means 23 in this manner are input to the coin discriminating means 25. On the other hand, a denomination signal produced by the denomination determining means 21 is input to the reference pattern data storing means 24. In response, the reference pattern data storing means 24 selects the reference pattern data of the denomination corresponding to the denomination signal from among the reference pattern data of coins mapped in the r-θ coordinate system and stored therein and outputs it to the coin discriminating means 25.

Figure 7:
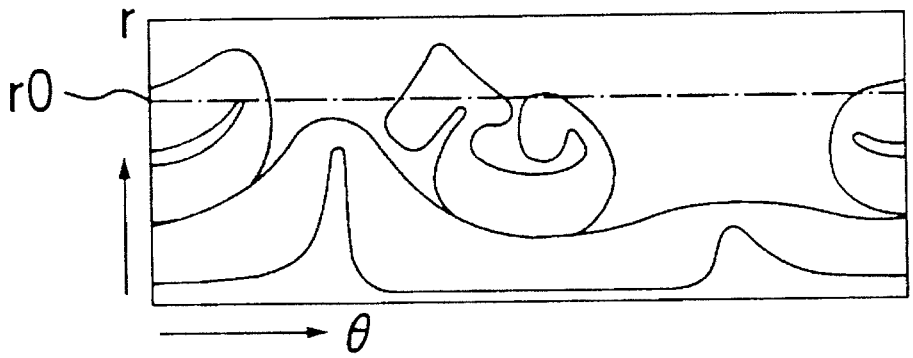
FIG. 7 is a view showing reference pattern data of the coin shown in FIG. 5.

FIG. 7 shows the reference pattern data of the coin 1 shown in FIG. 5 and mapped in the r-θ coordinate system. This data corresponds to the converted pattern data shown in FIG. 6. Since the converted pattern data shown in FIG. 6 is obtained in the pattern data converting means 23 by transforming the pattern data in the x-y coordinate system into the r-θ coordinate system based on the center coordinates (xc, yc) of the pattern data of the coin 1 determined by the center coordinate determining means 22, the zero point of the ordinate, namely, the zero point of the r-axis coincides with the zero point of the reference pattern data shown in FIG. 7. However, since the orientation of the coin 1 to be discriminated is usually offset angularly (rotationally) from that of the coin 1 used for producing the reference pattern data, the pattern data at the same θ value in FIGS. 6 and 7 are normally obtained from different portions of the coin 1. Accordingly, it is impossible to discriminate the denomination of the coin 1, the genuineness of the coin 1 and the like by directly comparing the converted pattern data in FIG. 6 and the reference pattern data in FIG. 7 and, therefore, it is necessary to correct the converted pattern data prior to the comparison so that the zero point of the converted pattern data in the θ axis coincides with the zero point of the reference pattern data in the θ axis.

In view of the above, the coin discriminating means 25 reads the pattern data values at a predetermined distance r0 from the data center of the converted pattern data shown in FIG. 6, namely, reads the pattern data values whose ordinate values are equal to a predetermined value r0 over 360 degrees, and reads the pattern data values at a predetermined distance r0 from the data center of the reference pattern data shown in FIG. 7, namely, reads the pattern data values whose ordinate values are equal to a predetermined value r0 over 360 degrees. Then, the coin discriminating means 25 compares the two sets of pattern data values, thereby correcting the deviation of the converted pattern data in the θ axis caused by the angular offset of the coin 1.

Figure 8:
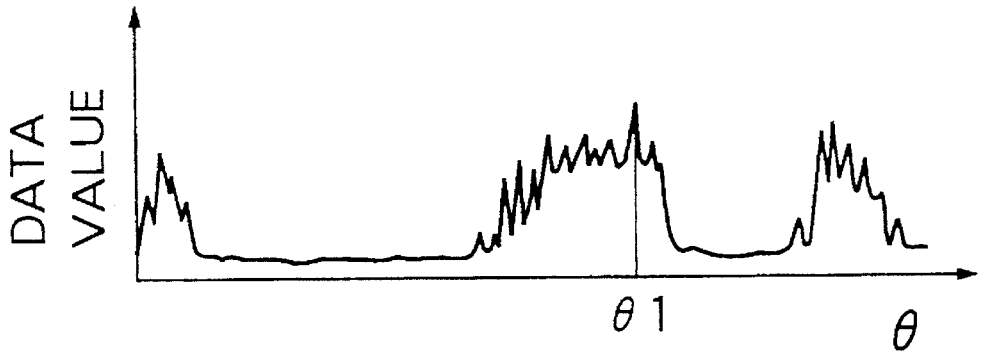
FIG. 8 is a graph showing pattern data values obtained by reading the converted pattern data shown in FIG. 6 over 360 degrees at a predetermined distance r0 from a data center.
Figure 9:
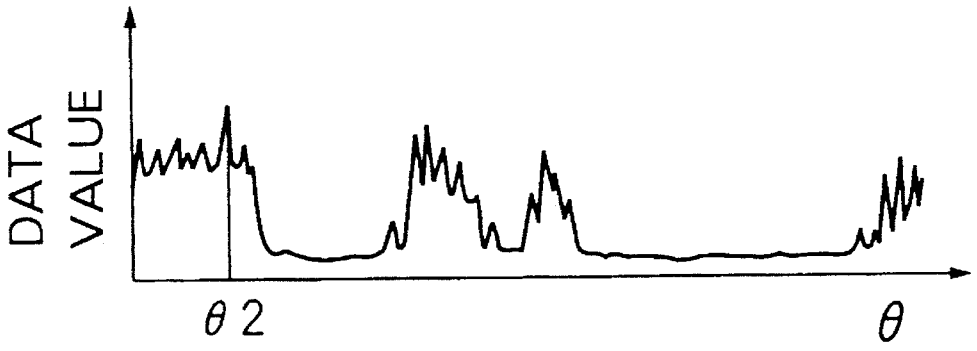
FIG. 9 is a graph showing pattern data value obtained by reading reference pattern data shown in FIG. 6 over 360 degrees at a predetermined distance r0 from the data center.

FIG. 8 is a graph showing pattern data values obtained by reading the converted pattern data shown in FIG. 6 over 360 degrees at a predetermined distance r0 from the data center and Figure is a graph showing pattern data values obtained by reading reference pattern data shown in FIG. 7 over 360 degrees at a predetermined distance r0 from the data center. In FIGS. 8 and 9, the ordinate represents data values and the abscissa represents the angle θ.

Coins 1 are fed through the coin passage 3 guided by the pair of guide rails 4 and, therefore, the center of the coin 1 passes along a predetermined locus on the transparent member 5. On the contrary, the coin 1 is usually offset angularly the coin used to produce the reference pattern data. Therefore, since the sets of pattern data at the same θ value in FIGS. 6 and 7 are normally obtained from different portions of the coin 1, it is necessary to correct the converted pattern data prior to the comparison so that the zero point of the converted pattern data in the θ axis coincides with the zero point of the reference pattern data in the θ axis.

Figure 10:
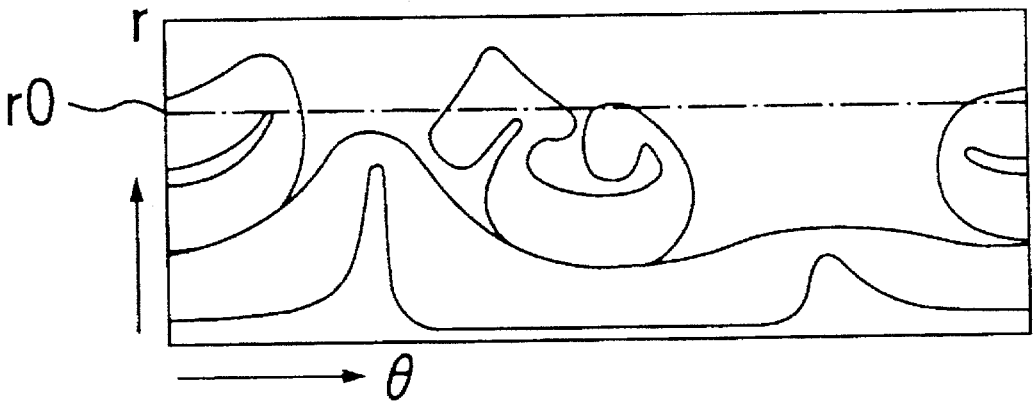
FIG. 10 is a view showing converted pattern data after remapping.

Accordingly, the coin discriminating means 25 obtains θ values θ1 and θ2 at which the pattern data value shown in FIG. 8 and the pattern data value shown in FIG. 9 are maximum respectively and remaps the converted pattern data shown in FIG. 6 so that θ1 becomes equal to θ2. FIG. 10 shows the thus remapped converted pattern data.

The coin discriminating means 25 compares the converted pattern data remapped in the above described manner and shown in FIG. 10 with the reference pattern data shown in. FIG. 9 and discriminates the denomination of the coin 1, the genuineness of the coin 1 and whether or not the coin 1 is a foreign coin, in accordance with the extent of how well the converted pattern data coincides with the reference pattern data.

The thus constituted coin discriminating apparatus which is an embodiment of the present invention discriminates coins in the following manner.

First, when a coin 1 is fed through the coin passage 3 and the coin sensor 13 detects that the coin 1 reaches a prescribed position on the transparent plate 7, light is projected onto the back surface of the coin 1 from the plurality of light emitting elements 9. The emitted light is reflected by the back surface of the coin 1 and is focused by the convex lens 12 to enter the area sensor 11. Since the plurality of light emitting elements 9 are arranged in the transparent plate 7 and the hole 8 of the transparent plate 7 is arranged immediately below the coin 1 to be discriminated such that the circumferential surfaces thereof are positioned outside of the coin 1 to be discriminated, light is projected onto the back surface of the coin 1 at a shallow angle with respect to the back surface of the coin 1 and light is reflected by the back surface of the coin 1 in accordance with the surface irregularities constituting the pattern thereof and is received by the area sensor 11.

The area sensor 11 produces pattern data in accordance with the intensity of received light, namely, the pattern irregularities of the back surface of the coin 1. Since the reflection members 10 are provided on the inner surfaces of side portions and upper and lower inner surfaces of the transparent plate 7, light is uniformly emitted from the transparent plate 7 with uniform intensity and reflected by the back surface of the coin 1. Therefore, if the denomination is the same, the same pattern data will be produced by the area sensor 11.

The pattern data produced by the area sensor 11 is mapped in the x-y coordinate system and stored in the mapped pattern data memory 20. FIG. 5 shows one example of pattern data of a coin 1 produced by the area sensor 11 and mapped and stored in the mapped pattern data memory 20.

The denomination determining means 21 calculates the outer diameter of the coin 1 based on the pattern data of the coin 1 mapped in the x-y coordinate system and stored in the mapped pattern data memory 20 and tentatively determines the denomination of the coin 1, thereby producing a denomination signal and outputting it to the reference pattern data storing means 24.

On the other hand, the center coordinate determining means 22 determines the center coordinates (xc, yc) of the pattern data of the coin 1 based upon the pattern data of the coin 1 mapped in the x-y coordinate system and stored in the mapped pattern data memory 20 and outputs it to the pattern data converting means 23.

Based on the center coordinates (xc, yc) of the pattern data of the coin 1 input from the center coordinate determining means 22, the pattern data converting means 23 transforms the pattern data of the coin 1 mapped in the x-y coordinate system and stored in the mapped pattern data memory 20 into an r-θ coordinate system. FIG. 6 shows the converted pattern data thus transformed into the r-θ coordinate system.

Based upon the denomination signal input from the denomination determining means 21, the reference pattern data storing means 24 selects the reference pattern data of the reverse surface of the coin 1 corresponding to the denomination from among the reference pattern data mapped into the r-θ coordinate system and stored therein and outputs it to the coin discriminating means 25. FIG. 7 shows one example of the reference pattern data output from the reference pattern data storing means 24 to the coin discriminating means 25.

Since the pattern data cannot be produced by the area sensor 11 with the coin 1 in a predetermined angular orientation and the coin 1 is normally offset angularly from the coin 1 used for producing the reference pattern data, as is clear from FIGS. 6 and 7, the converted pattern data is normally offset along the abscissa, namely, the θ axis, with respect to the reference pattern data. Therefore, it is necessary to correct the deviation of the converted pattern data in the θ direction and discriminate the coin 1 by comparing the converted pattern data with the reference pattern data.

Accordingly, the coin discriminating means 25 reads the pattern data values of the converted pattern data shown in FIG. 6 over 360 degrees whose ordinate values are equal to a predetermined value r0 and reads the pattern data values of the reference pattern data shown in FIG. 7 over 360 degrees whose ordinate values are equal to a predetermined value r0.

FIGS. 8 and 9 are graphs obtained by plotting the thus read converted pattern data values and reference pattern data values whose ordinate values are equal to a predetermined value r0. The coin discriminating means 25 further calculates θ values at which the converted pattern data values and the reference pattern data values become maximum respectively. The thus obtained θ value is θ1 in FIG. 8 and the θ value is θ2 in FIG. 9.

When θ1 and θ2 are obtained in this manner, the coin discriminating means 25 remaps the converted pattern data so that θ1 becomes equal to θ2. FIG. 10 shows an example of the converted pattern data thus remapped by the coin discriminating means 25. Since the deviation of the converted pattern data in the θ direction caused by the angular offset of the coin 1 has been corrected by remapping the converted pattern data, it is possible for the coin discriminating means 25 to discriminate whether the denomination of the coin 1 coincides with that tentatively determined by the denomination determining means 21, the genuineness of the coin 1 and whether or not the coin is a foreign coin by pattern matching the converted pattern data with the reference pattern data.

However, since it is impossible to feed the coin 1 so that one surface thereof always faces upward, if the coin is fed in such a manner that the reverse surface faces upward, the remapped converted pattern data never coincides with the reference pattern data of the reverse surface of the coin 1 of the denomination tentatively determined by the denomination determining means 21. Therefore, when the remapped converted pattern data does not coincides with the reference pattern data of the reverse surface of the coin 1 of the denomination selected in accordance with the denomination signal input from the denomination determining means 21, if the coin 1 is immediately discriminated as a counterfeit coin or a foreign coin, the coin discrimination accuracy becomes lowered.

Accordingly, in this embodiment, the converted pattern data is first compared with the reference pattern data of the reverse surface of the coin 1 of the denomination tentatively determined by the denomination determining means 21 and if they do not coincide, the converted pattern data is compared with the reference pattern data of the obverse surface of the coin 1 of the denomination in the same manner, thereby discriminating whether the denomination of the coin 1 coincides with that tentatively determined by the denomination determining means 21, the genuineness of the coin 1 and whether or not the coin is a foreign coin.

According to this embodiment, since pattern data is produced by detecting the entire surface of the coin 1 and discrimination of coins is made by comparing the pattern data with reference pattern data, the accuracy of discriminating coins can be improved. Further, since the deviation of the converted pattern data in the θ direction caused by the angular offset of a coin 1 can be corrected only by obtaining the values θ1 and θ2 at which the respective data values of the converted pattern data and the reference pattern data become maximum and remapping the converted pattern data so that θ1 becomes equal to θ2, it is possible to shorten the time for calculation, whereby coins 1 can be discriminated at high speed.

The present invention has thus been shown and described with reference to specific embodiments. However, it should be noted that the present invention is in no way limited to the details of the described arrangements but changes and modifications may be made without departing from the scope of the appended claims.

For example, in the above described embodiment, the deviation of the converted pattern data caused by the angular offset of the coin 1 is corrected by obtaining the θ values θ1 and θ2 at which the data values of the converted pattern data and the reference pattern data whose ordinate values are equal to r0 become maximum and remapping the converted pattern data so that θ1 becomes equal to θ2. However, depending upon the kind of coins, the data values of the reference pattern data whose ordinate values are equal to a predetermined value r0 may have the maximum value plus a plurality of values whose magnitudes are close to the maximum value. In such a case, the coin discriminating means 25 may make erroneous judgment because a data value which is not maximum was mistakenly detected as the maximum value, in which case the deviation of the converted pattern data in the θ direction caused by the angular offset of the coin 1 will not be corrected even if the converted pattern data are remapped. As a result, the coin will not be correctly discriminated. For preventing such erroneous discrimination, it is possible to discriminate the coin 1 by remapping the converted pattern data No times (No being an integer not smaller than 2) based on the data values in order from greater data value to smaller data value.

Further, instead of obtaining θ values θ1 and θ2 at which the data values of the converted pattern data and the reference pattern data whose ordinate values are equal to r0 become maximum, the square of the difference between the data values of the converted pattern data and the reference pattern data whose ordinate values are equal to a predetermined value r0 can be integrated over the range from 0 to 360 degrees of the θ value to obtain an integrated value and the graph of the data values of the converted pattern data shown in FIG. 8 be moved in parallel with the θ axis. When the thus calculated integrated value becomes minimum, it can be judged that the deviation of the converted pattern data caused by the angular offset of the coin 1 is corrected and the converted pattern data can be remapped to be compared with the reference data, thereby discriminating the coin 1. Moreover, the difference between the data values of the converted pattern data and the reference pattern data whose ordinate values are equal to a predetermined value r0 can be integrated over the range from 0 to 360 degrees of the θ value to obtain an integrated value and the graph of the data values of the converted pattern data shown in FIG. 8 be moved in parallel with the θ axis. When the thus calculated integrated value becomes minimum, it can be judged that the deviation of the converted pattern data caused by the angular offset of the coin 1 is corrected and the converted pattern data can be remapped to be compare with the reference data, thereby discriminating the coin 1.

Furthermore, in the above described embodiment, although the area sensor 11 is used as a sensor for detecting light reflected by the back surface of a coin 1, other types of sensors such as a line sensor may be used instead.

Moreover, in the above described embodiment, the light emitting elements 9 always emit light and the area sensor 11 receives the light reflected by the coin 1 positioned above the hole 8 and produce pattern data at a predetermined time determined by a coin detection signal output by the coin sensor 13 when it detects the coin 1. However, the coin sensor 13 may be caused to output a coin detection signal to means for controlling the light emitting elements 9 when it detects a coin 1, thereby causing the light emitting elements 9 to emit light at a predetermined time and the area sensor 11 to receive the light.

Furthermore, in the above described embodiment, although the reflection members 10 are provided on the inner surfaces of the side portions and the upper and lower inner surfaces of the transparent plate 7, the reflection members 10 may be provided at different portions depending upon the characteristics of the light emitting elements 9.

Moreover, in the above described embodiment, the converted pattern data is first compared with the reference pattern data of the reverse surface of the coin 1 of the denomination tentatively determined by the denomination determining means 21 and if they do not coincide, the converted pattern data is compared with the reference pattern data of the obverse surface of the coin 1 of the denomination in the same manner, thereby discriminating whether the denomination of the coin 1 coincides with that tentatively determined by the denomination determining means 21, the genuineness of the coin land whether or not the coin is a foreign coin. However, the converted pattern data can be first compared with the reference pattern data of the obverse surface of the coin 1 of the denomination tentatively determined by the denomination determining means 21 and if they do not coincide, the converted pattern data can be compared with the reference pattern data of the reverse surface of the coin 1 of the denomination in the same manner, thereby discriminating whether the denomination of the coin 1 coincides with that tentatively determined by the denomination determining means 21, the genuineness of the coin 1 and whether or not the coin is a foreign coin.

Further, in this specification and the appended claims, the respective means need not necessarily be physical means and arrangements whereby the functions of the respective means are accomplished by software fall within the scope of the present invention. In addition, the function of a single means may be accomplished by two or more physical means and the functions of two or more means may be accomplished by a single physical means.

We claim:

1. A coin discriminating apparatus comprising irradiating means for projecting light onto a coin, light receiving means for receiving light reflected by the coin and producing pattern data of the coin, pattern data storing means for storing the pattern data as mapped into an x-y coordinate system, center coordinate determining means for determining a center coordinate of the pattern data mapped in the x-y coordinate system in the pattern data storing means, pattern data converting means for, based upon the center coordinate of the pattern data in the x-y coordinate system determined by the center coordinate determining means, the pattern data stored in the pattern data storing means into an r-θ coordinate system and producing converted pattern data, reference pattern data storing means for storing reference pattern data mapped in the r-θ coordinate system and coin discriminating means for correcting the converted pattern data along a θ-axis and comparing the corrected converted pattern data with the reference pattern data to discriminate the coin.

2. A coin discriminating apparatus in accordance with claim 1 wherein denomination determining means is further provided for tentatively determining a coin denomination based upon the pattern data stored in the pattern data storing means and wherein the coin discriminating means is constituted so as to discriminate the coin by comparing reference pattern data of the denomination tentatively determined by the denomination determining means and the corrected converted pattern data.

3. A coin discriminating apparatus in accordance with claim 1 wherein each of the reference pattern data consists of those of both surfaces of coin of one denomination.

4. A coin discriminating apparatus in accordance with claim 2 wherein each of the reference pattern data consists of those of both surfaces of coin of one denomination.

5. A coin discriminating apparatus in accordance with claim 1 wherein the irradiating means comprises light emitting means for emitting light and light directing means for uniformly directing light emitted from the light emitting means onto the surface of the coin at a shallow angle.

6. A coin discriminating apparatus in accordance with claim 2 wherein the irradiating means comprises light emitting means for emitting light and light directing means for uniformly directing light emitted from the light emitting means onto the surface of the coin at a shallow angle.

7. A coin discriminating apparatus in accordance with claim 3 wherein the irradiating means comprises light emitting means for emitting light and light directing means for uniformly directing light emitted from the light emitting means onto the surface of the coin at a shallow angle.

8. A coin discriminating apparatus in accordance with claim 4 wherein the irradiating means comprises light emitting means for emitting light and light directing means for uniformly directing light emitted from the light emitting means onto the surface of the coin at a shallow angle.

* * * * *